US010426283B2

(12) United States Patent
Karelis et al.

(10) Patent No.: US 10,426,283 B2
(45) Date of Patent: Oct. 1, 2019

(54) MULTI-POSITION SUIT HANGER SYSTEM AND METHOD

(71) Applicants: Charles Howard Karelis, North Chatham, NY (US); Alexander Oliver Karelis, Philadelphia, PA (US); Bryce Bunkers, Crystal, MN (US); David E. Barnard, Saint Paul, MN (US)

(72) Inventors: Charles Howard Karelis, North Chatham, NY (US); Alexander Oliver Karelis, Philadelphia, PA (US); Bryce Bunkers, Crystal, MN (US); David E. Barnard, Saint Paul, MN (US)

(73) Assignees: Charles Howard Karelis, North Chatham, NY (US); Alexander Oliver Karelis, Philadelphia, PA (US)

( * ) Notice: Subject to any disclaimer, the term of this patent is extended or adjusted under 35 U.S.C. 154(b) by 0 days.

(21) Appl. No.: 15/468,947

(22) Filed: Mar. 24, 2017

(65) Prior Publication Data

US 2017/0273489 A1 Sep. 28, 2017

Related U.S. Application Data

(60) Provisional application No. 62/312,559, filed on Mar. 24, 2016.

(51) Int. Cl.
*A47G 25/28* (2006.01)
*A47G 25/16* (2006.01)

(52) U.S. Cl.
CPC ..... *A47G 25/28* (2013.01); *A47G 25/16* (2013.01)

(58) Field of Classification Search
CPC ..... A47G 25/14; A47G 25/16; A47G 25/28; A47G 25/32; A47G 25/34
USPC ..... 223/88–89, 87, 98
See application file for complete search history.

(56) References Cited

U.S. PATENT DOCUMENTS 1,867,614 A * 7/1932 Cuscaden ..... A47G 25/28 223/88
2,185,253 A * 1/1940 Klein ..... A47G 25/28 223/88
2,512,133 A * 6/1950 Baer, Sr. ..... A47G 25/442 223/90
2,634,032 A * 4/1953 Bartlett ..... A47G 25/16 211/170
2,685,991 A * 8/1954 Goza ..... A47G 25/28 223/88

(Continued)

OTHER PUBLICATIONS

Amazon.com: "Suit and Trouser/Pants Clothes Hanger With Clips"; https://www.amazon.com/gp/product/B00W4G40YA/ref=oh_aui_detailpage_o00_s00?ie=UTF8&psc=1; Available at least as early as Jul. 3, 2015 (based on the first customer review on p. 6).

*Primary Examiner* — Nathan E Durham
(74) *Attorney, Agent, or Firm* — Heslin Rothenberg Farley & Mesiti P.C.; Kristian E. Ziegler

(57) ABSTRACT

A multi-position hanger including a main body, a hook, a wishbone and a pants bar. The hook is attached to the main body. The wishbone and the pants bar are also attached to the main body. The wishbone is attached to the main body at a first offset in a first direction from the hook, and the pants bar is attached to the main body at a second offset in a second direction from the hook. Loading the wishbone produces a moment in a first direction and loading the pants bar produces a moment in a second, opposite direction.

17 Claims, 12 Drawing Sheets

(56) References Cited

U.S. PATENT DOCUMENTS

| | | | | | |
|---|---|---|---|---|---|
| 3,651,999 | A * | 3/1972 | Fiocca | A47G 25/16 | 223/88 |
| 3,935,976 | A * | 2/1976 | Mizrach | A47G 25/18 | 223/88 |
| 4,728,016 | A * | 3/1988 | McPhee | A47G 25/32 | 211/116 |
| 5,085,357 | A * | 2/1992 | Chen | A47G 25/4038 | 223/85 |
| 5,645,200 | A * | 7/1997 | McDowell | A47G 25/28 | 223/85 |
| 6,126,049 | A * | 10/2000 | Gish | A47G 25/26 | 223/96 |
| 6,213,359 | B1 * | 4/2001 | Gish | A47G 25/26 | 223/85 |
| 6,962,276 | B2 * | 11/2005 | Fradkin | A47G 25/28 | 223/88 |
| D546,568 | S * | 7/2007 | Foreman | D6/319 | |
| 9,113,736 | B1 * | 8/2015 | Antler | A47G 25/32 | |
| 2004/0026469 | A1 * | 2/2004 | Grasso | A47G 25/442 | 223/98 |
| 2005/0061839 | A1 * | 3/2005 | Fradkin | A47G 25/28 | 223/88 |

* cited by examiner

MULTI-POSITION SUIT HANGER SYSTEM AND METHOD

RELATED APPLICATIONS

This application claims the benefit under 35 U.S.C. § 119(e) of prior U.S. Provisional Patent Application No. 62/312,559, filed Mar. 24, 2016, which is incorporated herein by reference.

TECHNICAL FIELD

Various embodiments described herein relate to a multi-position suit hanger system and a method for using the same.

BACKGROUND

Hangers for clothes are ubiquitous. They populate closets throughout the world and are used to keep people's clothes neat and organized. Some hangers are specialized and used to hang expensive and important clothes, such as a suit of clothes. A suit of clothes typically includes a set of pants and matching suit coat made of the same material. Suits are a common way for some to make a good impression so it is important to hang a suit properly so as to minimize wrinkles and to keep the suit clean. One problem associated with hanging suits occurs when dressing or undressing. The typical hanger for suits includes the hanger having two arms. A pants bar is connected to the two arms and may or may not have a mechanism for holding the pants in place. When dressing, the suit coat must be removed from the hanger and set aside. The pants can then be removed from the pants bar. The pants and shirt are put on initially and the suitcoat is then put on after picking it up from its temporary resting spot. When undressing at the end of the day, the suit coat must be removed and set aside before it is hung after the pants have been placed onto the pants bar between the two arms of the hanger. One solution, a suit valet, is a costly and bulky piece of furniture that generally accommodates only one suit.

SUMMARY OF THE INVENTION

The new hanger will make it easy to hang up a suit jacket and a pair of trousers in the order you take them off when undressing—jacket first. It will be unnecessary for someone taking off a suit to put the suit jacket aside while hanging up the trousers.

Likewise, the invention will make it unnecessary to take the suit jacket off the hanger and put it aside to get at the pants when dressing.

Therefore the invention will save suit-wearers steps at both ends of the day. Further it will cut the risks of wrinkling the jacket or getting it dirty. This can easily happen when a jacket is put aside for any length of time, as when a suit-wearer removes his or her jacket at the end of a work day, hours before undressing for bed. These are just a few of the benefits for suit wearers or owners. More benefits will be evident as the various embodiments are further described below.

To get these two benefits, people have sometimes used standing wooden "valets," and they have sometimes hung their suit jackets and pants on separate hangers.

Our invention has advantages over both. Since the invention is a hanger, it takes up a fraction of the space of a standing valet unit, indeed no floor-space at all. Since it is a single hanger, our invention makes it easy to keep jackets and matching trousers together. Keeping the pieces of a suit from getting separated in the closet is beneficial, since most suits are dark, and closets are often badly lit. Another advantage over using two hangers is that our invention takes up less lateral closet space. A third advantage over using two hangers is that the zippered garment bags used for storing and transporting suits have only small holes at the top for the hooks of hangers, which tend to tear when multiple hooks are stuck through them. Last, the hanging hooks found over the rear doors of many cars don't accommodate multiple hangers easily.

In addition, the invention and its embodiments will benefit clothing salespeople, who hang and unhang suits for customers repeatedly.

DETAILED DESCRIPTION

Figure 1:
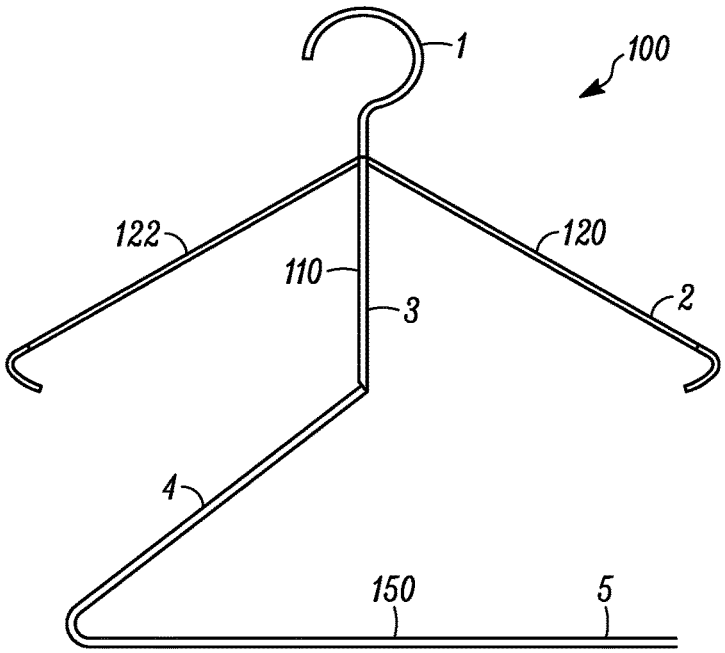
FIG. 1 is a front view of a multi-position hanger, according to an example embodiment.
Figure 2:
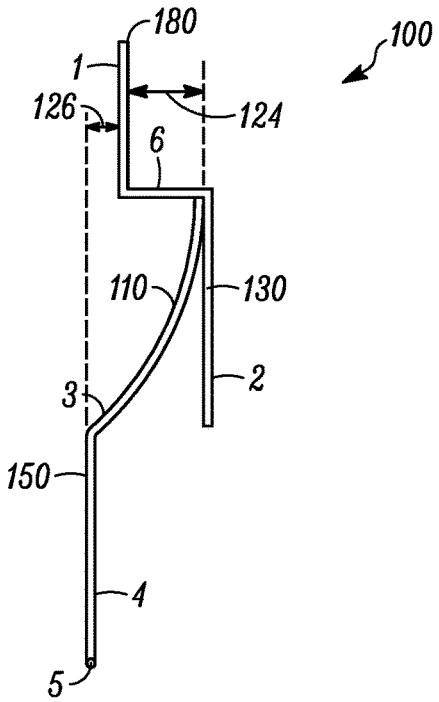
FIG. 2 is a side view of a multi-position hanger, according to an example embodiment.
Figure 3:
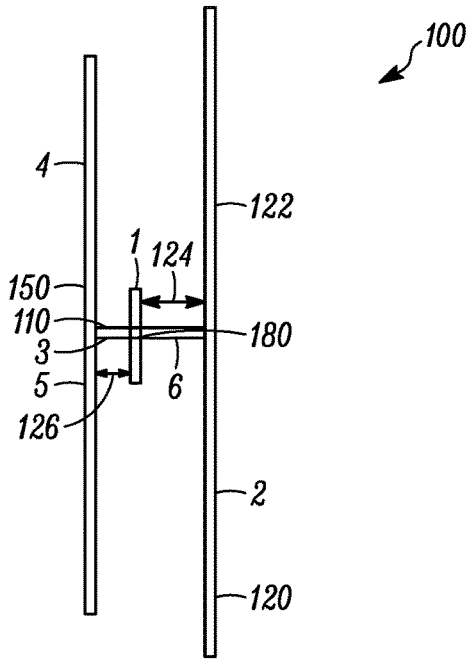
FIG. 3 is a top view of a multi-position hanger, according to an example embodiment.
Figure 4:
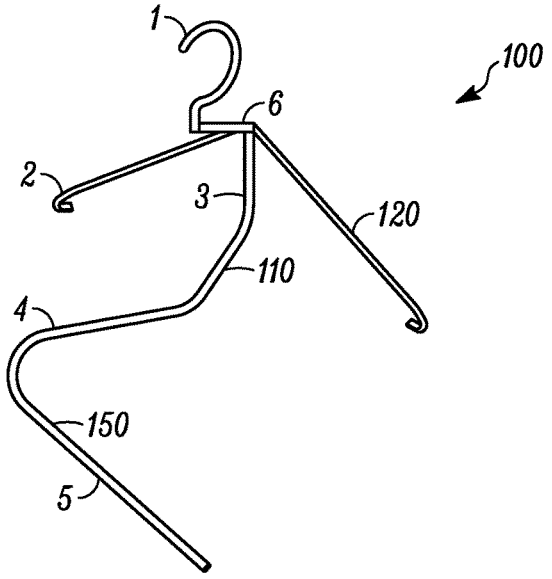
FIG. 4 is a perspective view of a multi-position hanger, according to an example embodiment.

FIGS. 1-6 show one example embodiment of the suit hanger 100. Now referring to FIGS. 1-4, the suit hanger will be more fully described. FIG. 1 is a front view of a multi-position hanger, according to an example embodiment. FIG. 2 is a side view of a multi-position hanger, according to an example embodiment. FIG. 3 is a top view of a multi-position hanger, according to an example embodiment. FIG. 4 is a perspective view of a multi-position hanger, according to an example embodiment. The suit hanger 100 includes a main body 110. The main body 110 is curved. In this particular embodiment, the curved main body is in the form of a swoosh 3. Attached the top of the main body 110 is a question mark hook 1. A hook offset bar 6 has one end attached to the main body 110 and another end attached to the question mark-shaped hook 1. Also attached to the main body is a wishbone 2. The wishbone has a first arm 120 and a second arm 122. The first arm 120 and the second arm 122 are formed to receive a jacket or suitcoat (shown in FIGS. 5 and 6). The wishbone 2 is attached an end of the body 110 closest to the question mark hook 1. A pants hanger 150 is attached to the other end of the main body 110 of the suit hanger 100. The pants hanger 150 is an open jaw type hanger and includes an open jaw connector bar 4 and a pants hanger bar 5 connected to the open jaw connector bar 4. The pants hanger bar 5 is generally horizontal during use.

It should be noted that the bar 6 is not perfectly horizontal at all times during the operation of the hanger 100. When the hanger 100 is loaded, the bar 6 is more horizontal than when the hanger 100 is unloaded. This will be discussed in further detail below.

The hanger 100 also includes a pivot point 180 which is somewhere along the surface of the question mark hook 1. The pivot point 180 is at or near the contact point of the question mark hook 1 when it hangs on a closet rod or the like (not shown). It should be noted that the pivot point 180 shifts or moves along the surface of the question mark hook 1 as the hanger 100 is loaded with a coat or jacket on the wishbone 2, and then again when the pants are placed on the pants bar 5. The pivot point 180 shown in FIGS. 2 and 3 is for the sake of illustration and generally will move.

In addition, it should be noted that question mark hook 1 is offset a distance 124 from the arms 120, 122 of the wishbone 2. In addition, the question mark hook 1 is offset a distance 126 from the pants bar 5 of the pants hanger 150. Given the fact that the pivot point is on the question mark hook 1, one can see that the offset distance 124 is a moment arm for producing a moment (force at a distance) when a suit coat or jacket (shown in FIGS. 5 and 6) is loaded or placed onto the wishbone 1. This causes a clockwise moment about a pivot point on the question mark hook 1. Similarly, that the offset distance 126 is a moment arm for producing a moment (force at a distance) when pants (shown in FIGS. 5 and 6) are loaded or placed onto the pants bar 5. Loading the pants bar 5 with pants increases a counter clockwise moment about the pivot point 180.

Figure 5:
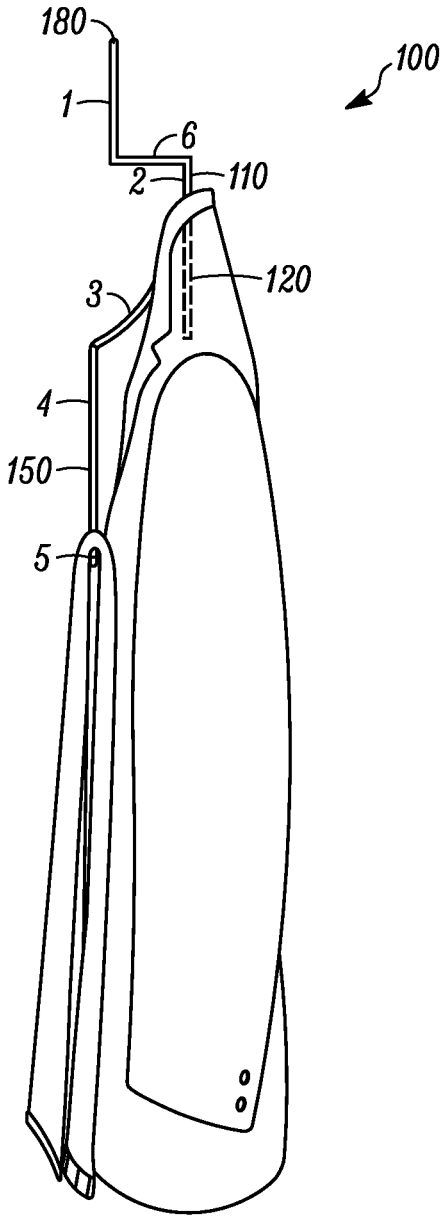
FIG. 5 is a side view of a multi-position hanger in a fully nested position, according to an example embodiment.
Figure 6:
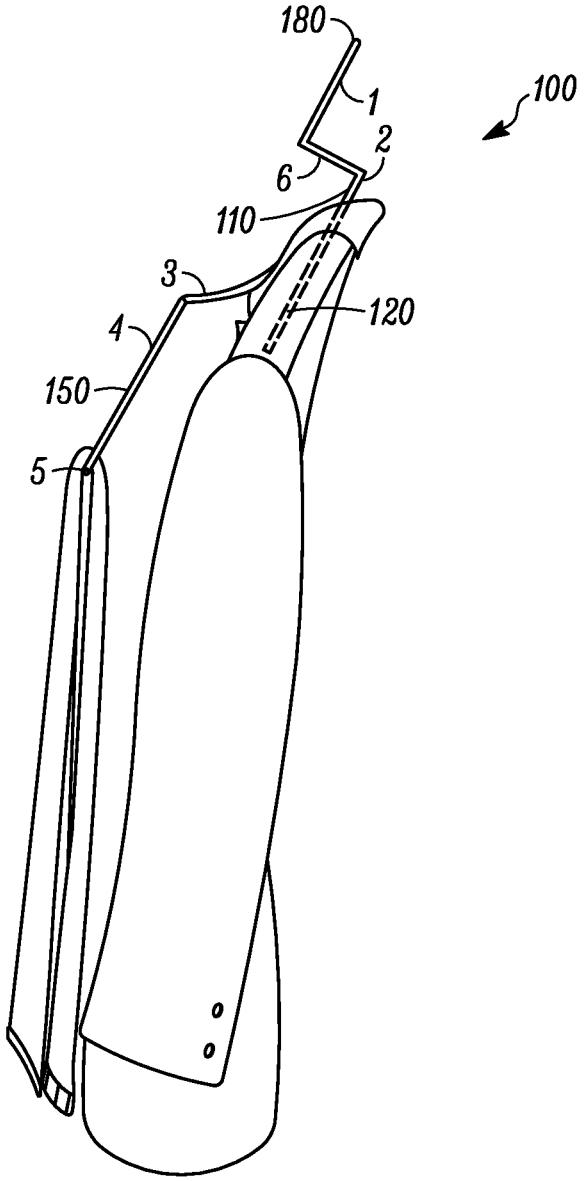
FIG. 6 is a side view of a multi-position hanger in a kicked out position just before loading the pants bar 5 with a set of pants, according to an example embodiment.

Now turning to FIGS. 5 and 6, the operation of the hanger will be more fully described. FIG. 6 is a side view of a multi-position hanger in a kicked out position just before loading the pants bar 5 with a set of pants, according to an example embodiment.

FIG. 6 when the coat is hung on the wishbone 2, the increased clockwise moment about the pivot point 180 moves the pants bar 5 out away from the pivot 180 of the hanger. In this kick out position, the effect is like the pants bar 5 being presented to the user to invite the user to place the pants on the pants bar 5. Again, FIG. 6 shows the hanger 100 before the counter clockwise moment produced by loading the pants onto the pants bar 5 has taken effect. In other words, the pants are either hovering over the pants bar 5 or have just initially been placed on the pants bar 5.

The loading of the pants onto the pants bar 5 produces a counter clockwise moment that acts to move the entire hanger 100 to the position shown in FIG. 6. In the position shown in FIG. 6, the hanger 100 presents a slimmer profile when compared to the kick out position shown in FIG. 6. Basically, the open jaw connector bar 4 in FIG. 6 is now closer to a vertical position so that the hanger 100 with the suit hanging on it presents a slimmer profile or width when hanging on the closet rod. FIG. 6 represents the final resting position of the suit as hung on the hanger 100 on a closet rod in a closet.

FIG. 5 is a side view of a multi-position hanger in a fully nested position, according to an example embodiment. FIG. 6 is a side view of a multi-position hanger in a before being fully loaded, according to an example embodiment. FIG. 6 is the view from the side with jacket hung on wishbone, which is 2, and pants draped over the substantially horizontal pants bar 5. In this FIG. 6, the hanger is shown just before the force of gravity swings the substantially horizontal pants bar 5 down, bringing pants snug up against the jacket, as shown in FIG. 5.

The wishbone, 2, is held in the right hand and the jacket in the left hand. (This assumes a right-handed user.) The left-hand wing of the wishbone is slipped into the left shoulder of the jacket, and the hanger is held through the jacket fabric. Then using the right hand, the right-hand wing of the wishbone is slipped into the right shoulder of the jacket. The wishbone may be tilted slightly to make the clearance between the jacket and the horizontal pants bar bigger. Then the hanger is hung up with only the jacket hung on the hanger and not the pants. Due to the offsetting of the hook, 1, shown in FIG. 2, the weight of the jacket automatically kicks out the substantially horizontal pants bar, 5. This makes it easy to drape the pants over the bar 5, as shown in FIG. 6. The weight of the pants then swings the bar, 5, down into the position shown in FIG. 5. The pieces of the suit have been hung up in the natural order.

Alternative Embodiments:

In another embodiment of the invention, the tubing that constitutes the wishbone, 2, is replaced by a hollow molded plastic wishbone, which is rounded at the ends to improve the draping of the jacket when hung up. In a further refinement of this embodiment, the molded wishbone is enabled to rock backwards and forwards, without twisting. This is achieved by the presence of a small cylinder which is attached to the hook offset bar 6, just at the point where it meets the swoosh, 3, and which fits up inside a half cylindrical housing in the underside of the hollowed out molded plastic wishbone 2. The opening in the wishbone 2 through which the tubing goes would have to be enlarged into a slot running back to front to allow this rocking to occur. By this means the suit jacket can hang absolutely straight even when the open jaw pants hanger, 4, is kicked out, as in FIG. 6.

With respect to the balance question, the invention has a number of alternative embodiments conforming to the following rule or principle. Let n be the multiple that the length of the hook offset bar, 6, is of the length of the swoosh, 3, as seen from above as in FIG. 3. This ratio could be 1:1 or 2:1 and so on. In the initially described example embodiment described above, that ratio is 2:1. However it could be 1:1 if the objective of minimizing lateral space taken up by the loaded hanger were given up. Then the rule is this. The weight of the wishbone, 2, plus the weight of the jacket times n must equal the weight of the pants plus the weight of the horizontal bar, 5.

Another alternative embodiment would be to make the hanger from some rigid material other than metal tubing, such as thick wire or plastic. Still another embodiment would be to enhance the rigidity of the whole hanger by "completing" one or both of the open triangular shapes, the wishbone or the open jaw pants hanger, by adding a third side.

Another embodiment would be to make the hook opening, in the question mark hook, 1, elliptical rather than round, to allow the hook to tip over enough when only the jacket is on the hanger.

Figure 7:
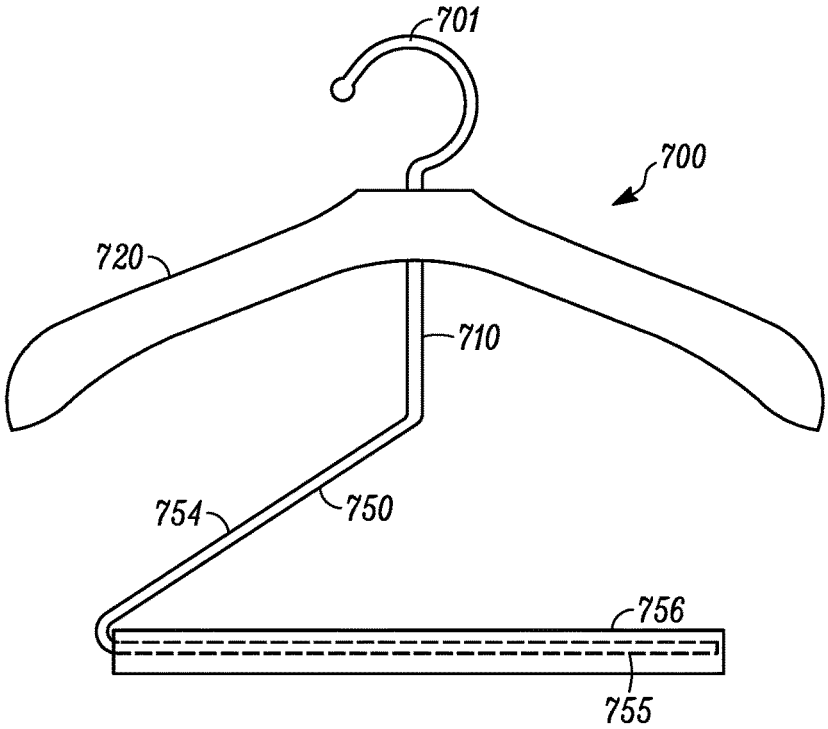
FIG. 7 front view of a multi-position hanger, according to an example embodiment.
Figure 8:
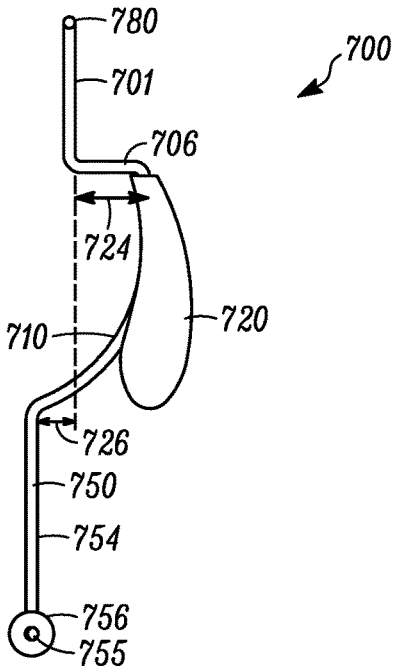
FIG. 8 is a side view of a multi-position hanger, according to an example embodiment.
Figure 9:
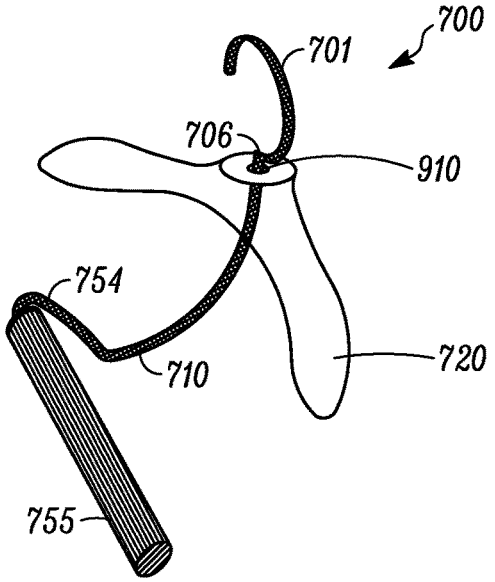
FIG. 9 perspective view of a multi-position hanger, according to an example embodiment.

FIG. 7 is front view of a multi-position hanger 700, according to another example embodiment. FIG. 8 is a side view of a multi-position hanger, shown in FIG. 7. FIG. 9 is a perspective view of a multi-position hanger shown in FIGS. 7 and 8. FIGS. 7-9 will now be referenced to show and describe still another example embodiment of a hanger 700.

The suit hanger 700 includes a main body 710. The main body 710 is curved. In this particular embodiment, the curved main body is in the form of a swoosh. Attached the top of the main body 710 is a hook offset bar 706. The hook offset bar 706 has one end attached to the main body 110 and another end attached to a question mark-shaped hook 701. A pants hanger 750 is attached to the other end of the main body 710 of the suit hanger 700. The pants hanger 750 is an open jaw type hanger and includes an open jaw connector bar 754 and a pants hanger bar 755 connected to the open jaw connector bar 754. The pants hanger bar 755 includes a sleeve 756. The sleeve increases the radius of the pants hanger and provides a greater or larger surface over which the pants drape on the pants bar. The greater or larger surface decreases the possibility of the pants bar producing a crease across the leg of the pants. In other embodiments, the pants hanger bar 755 could be made with a larger radius. Any number of materials could be used to form a sleeve 756 or a suitable pants hanger bar 755 with a radius sufficient to substantially prevent pant leg creasing The hanger 700 also has a separate wishbone 720. Thus, the wishbone 720 can be made of the same or a different material than the main body 710 of the hanger 700. In one embodiment, the wishbone 720 can even be made of molded plastic. The wishbone 720 includes an opening 910 therein (shown in FIG. 9). The main body 710, the hanger offset bar 706 and the question mark hook 701 can thread through the opening 910 during assembly.

Figure 10:
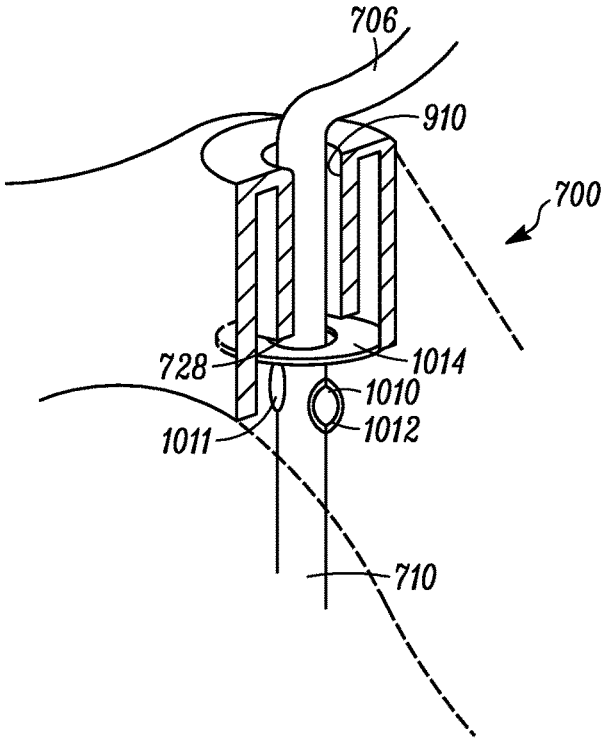
FIG. 10 is a perspective partial cut-away view of a connection of the main body of the multi-position hanger to the wishbone, according to an example embodiment.

FIG. 10 is a perspective partial cut-away view of a connection of the main body of the multi-position hanger to the wishbone, according to an example embodiment. The main body includes a swage 1010. The swage 1010 is formed by deforming a portion of the main body 710 of the hanger 700 which results in a first stop 1011 and a second stop 1012 along the main body 710. A washer 1014 is slipped over the hook 701 and the offset bar 706 to a position on the main body 710 above the stops 1011, 1012 of the swage 1010. The wishbone 720, in one embodiment, sits atop the washer 1014. The washer also fits within a recess 728 in the wishbone 720. As shown, the recess is formed by a shortened sidewall associated with the opening 910 in the wishbone 720. It should be noted that the wishbone 720 can be made or formed of a solid material and that the recess 728 is within the solid material. In another embodiment, adhesive can be used to hold the washer with respect to the wishbone 720 or with respect to the shaft of the main body 710 or both.

It should be noted that two of the many differences associated with the embodiment shown in FIGS. 7-10 are the use of a separate wishbone 720 and the modifications needed to attach the wishbone 720 to the main body 710 of the hanger 700. Yet another embodiment might be to manufacture the pants hanger 750, the main body 710, the offset bar 706 and the hook 701 from a single piece of stock by bending or other forming of materials.

In operation, the hanger 700 works in much the same way as the previously described embodiments. The offset bar 706 results in the wishbone 720 being offset from a pivot point on the hook 701 by a distance 724 and an offset distance 726 between the open jaw connector bar 754 and the hook 701. Each of these structures produces a moment about the pivot point. When the wishbone 720 is loaded with a coat, the resulting increase in clockwise moment results in the pants bar being placed in a kick out position. Loading the pants bar 755, 756 with pants increases a counter clockwise moment about the pivot point 780 so that the pants move to a position where the open jaw connector bar 754 is substantially vertical. The pants move toward the suitcoat and hang proximate one another.

Figure 11:
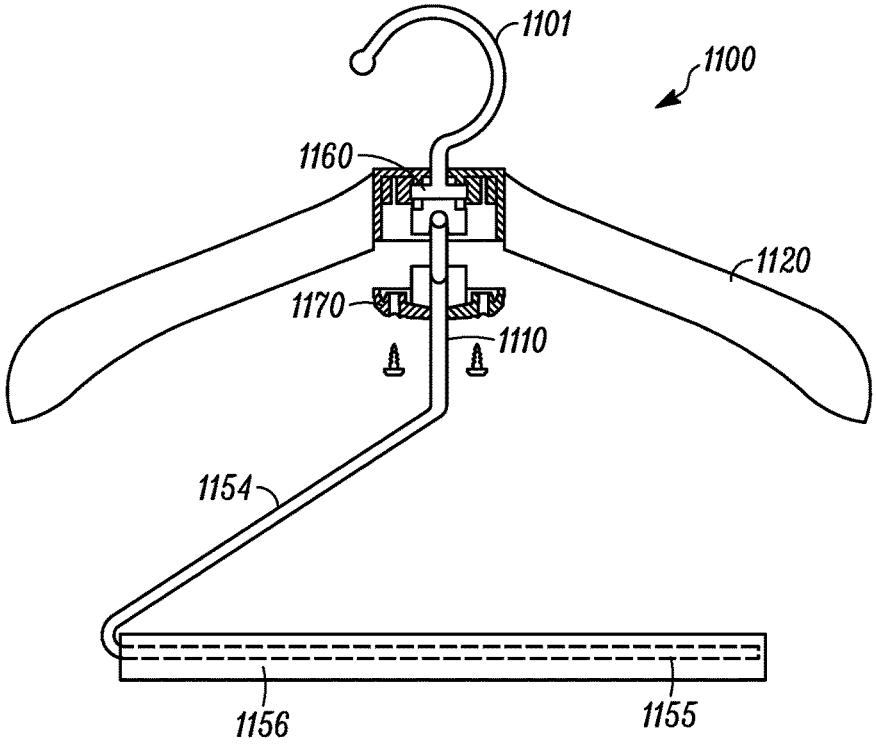
FIG. 11 partially cut-away front view of a multi-position hanger, according to yet another example embodiment.
Figure 12:
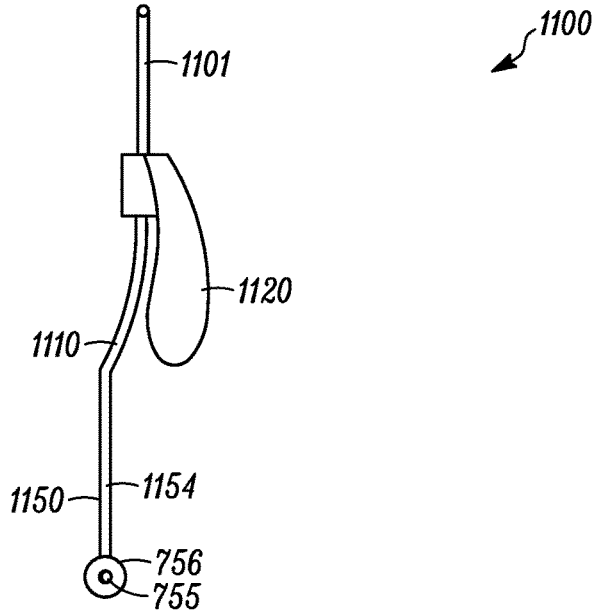
FIG. 12 side view of a multi-position hanger, according to yet another example embodiment.
Figure 13:
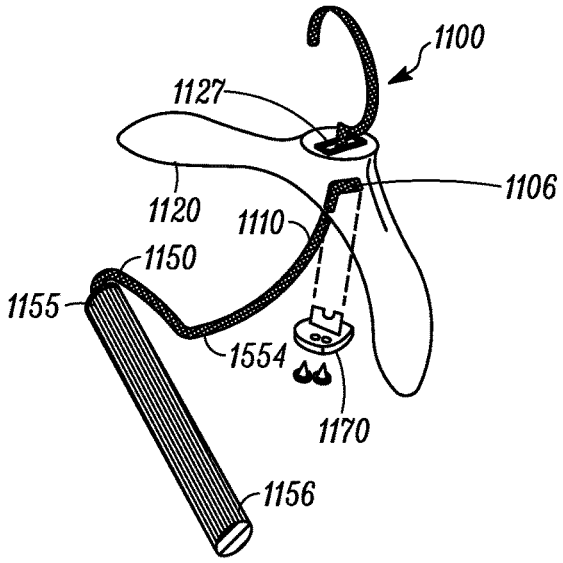
FIG. 13 partially exploded perspective view of a multi-position hanger, according to yet another example embodiment.
Figure 14:
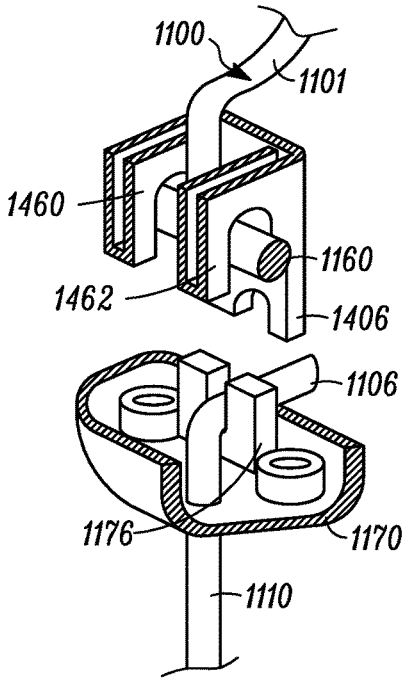
FIG. 14 a perspective partial cut-away view of a connection of the main body of the multi-position hanger to the wishbone, the wishbone and the hook, according to yet another example embodiment.

FIGS. 11-14 will now be referenced to show and describe the operation of still another example embodiment of a hanger 1100. FIG. 11 perspective view of a multi-position hanger, according to yet another example embodiment. FIG. 12 side view of a multi-position hanger, according to yet another example embodiment. FIG. 13 partially exploded perspective view of a multi-position hanger, according to yet another example embodiment. FIG. 14 a perspective partial cut-away view of a connection of the main body of the multi-position hanger to the wishbone, the wishbone and the hook, according to yet another example embodiment.

The suit hanger 1100 includes a main body 1110. The main body 110 is curved. In this particular embodiment, the curved main body is in the form of a swoosh. Attached the top of the main body 1110 is a return bar 1106. The hook offset bar 1106 has one end attached to the main body 1110. A pants hanger 1150 is attached to the other end of the main body 1110 of the suit hanger 1100. The pants hanger 1150 is an open jaw type hanger and includes an open jaw connector bar 1154 and a pants hanger bar 1155 connected to the open jaw connector bar 1154. The pants hanger bar 1155 includes a sleeve 1156. In another embodiment, shown in FIG. 13, the pants hanger bar 1155 is formed with a radius sufficient to substantially prevent formation of a crease across the pants leg along a fold line where the pants contact the pants hanger bar 1155.

The hanger 1100 also includes a wishbone 1120. One of the main differences associated with this particular embodiment is that a question mark hook 1101 includes a T-bar 1160 which is rotatably attached to the wishbone 1120. The question mark hook 1101 does not directly attach to the main body 1110. A capture plate 1170 captures the T-bar 1160 within the wishbone 1120 and allows the T-bar 1160 to pivot or rotate. This arrangement lowers the pivot point of the hanger 1100 when compared to the other embodiments discussed above (shown in FIGS. 1-10) where the pivot point is on the question mark hook 1101. The capture plate 1170 also includes a feature for capturing the return bar

1106. The return bar 1106 does not rotate with respect to the wishbone 1120. The capture plate 1170 is provided with an opening 1172 through which the main body 1110 passes. The capture plate 1170 also includes features that hold the return bar with respect to the wishbone 1120 and will not allow substantial movement between the main body 1110 and the wishbone 1120. The capture plate 1170 also includes features that allow the T-bar 1160 to rotate with respect to the wishbone 1120.

These features will now be discussed with respect to FIG. 14. The wishbone 1120 has several features. A return capture plate 1170 also includes some of the other features. As shown, the return capture plate attaches to the wishbone 1120 to complete the assembly and complete the various connections. The wishbone 1120 includes a first axle support 1460 and a second axle support 1462. The axle supports form a u-shaped slot that projects down toward the return capture plate 1170. The first axle support 1460 and the second axle support 1462 each have a pair of surfaces which terminate at or near an interior floor of the return capture plate. In other words, the floor of the return capture plate caps the u-shaped openings in the first axle support 1460 and the second axle support 1462. The ends of the T bar 1160 extend through the openings in the first axle support 1460 and the second axle support 1462. The T-bar 1160 is cylindrically shaped and has a diameter that allows the T-bar 1160 to rotate within the openings formed. The T-bar 1160 is the axle supported by the first axle support 1460 and the second axle support 1462.

The wishbone 1120 also includes a first return support 1406. As shown in FIG. 14, the first return support 1406 is broken with one end attached to the wishbone 1120 and another end wrapping or surrounding the return bar 1106. The first return support includes a u-shaped opening that wraps around the cylindrical return bar 1106. The first return support 1406 supports a first portion of the cylindrical return bar 1106. The first return support 1406 prevents or limits travel of the return bar toward the hook 1101. The return capture plate 1170 includes a second return support 1176 which also includes a u-shaped opening that wraps around a portion of the cylindrical return bar 1106. The second return support 1176 supports a second portion of the cylindrical return bar 1106 and limits travel in a downward direction. The first return support 1406 and the second return support 1176 hold the main body portion 1110 of the hanger 1100 with respect to the wishbone 1120. The return capture plate 1170 includes an opening 1172. The main body 1110 is positioned within the opening 1172 in the return capture plate 1170. This further supports the attachment of the main body 1110 with respect to the wishbone.

Figure 15:
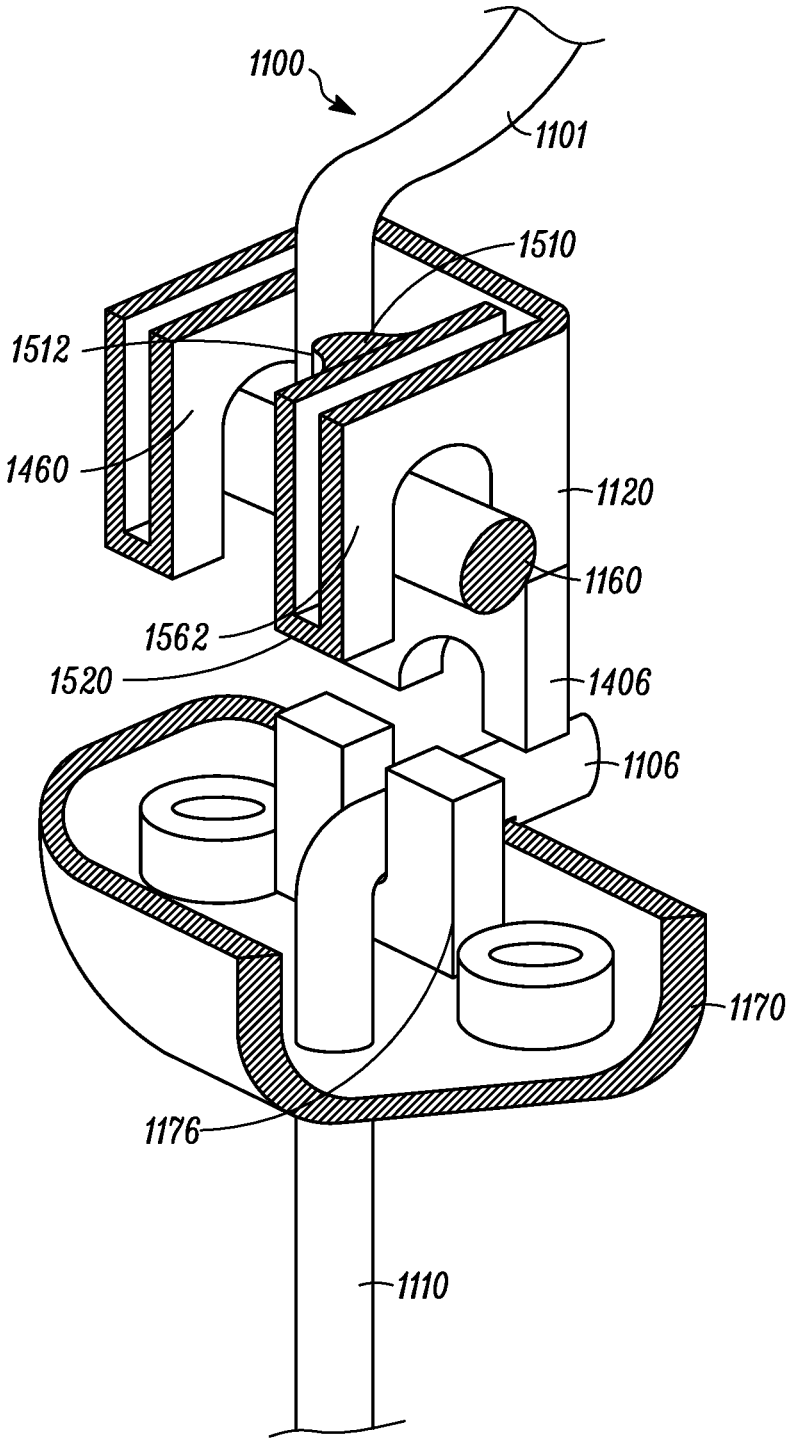
FIG. 15 is a perspective partial cut-away view of a connection of the main body of the multi-position hanger to the wishbone, the wishbone and the hook, according to still another example embodiment.

FIG. 15 a perspective partial cut-away view of a connection of the main body of the multi-position hanger to the wishbone, the wishbone and the hook, according to still another example embodiment. FIG. 15 is similar to FIG. 14. Rather than provide a full description of FIG. 15, the discussion will be limited to the differences between FIG. 14 and FIG. 15. The main difference is that one of the axle supports 1562 includes a click stop 1510. The click stop 1510 includes tab or cam surface 1512. The axle support is formed with a living hinge 1520. The living hinge produces a spring force toward the other axle support. The hanger hook and T bar assembly rotate between a nested position and a kickout position in which the pants bar is kicked out or presented to the user. The click stop 1510 is shaped to hold the hook in one of the kickout position or the nested position regardless of what the hanger 1500 is holding. The rotational position of the hook and T-bar assembly can be changed by applying an additional force between the wishbone 1120 and the hook 1101. This moves the hook 1101 over the click stop 1110 or more specifically over the tab or cam surface to the other position. Advantageously, the pants bar can be held in the kick out position without having to load the jacket or coat on the wishbone. This may ease use of the hanger 1500 by certain users.

Figure 16:
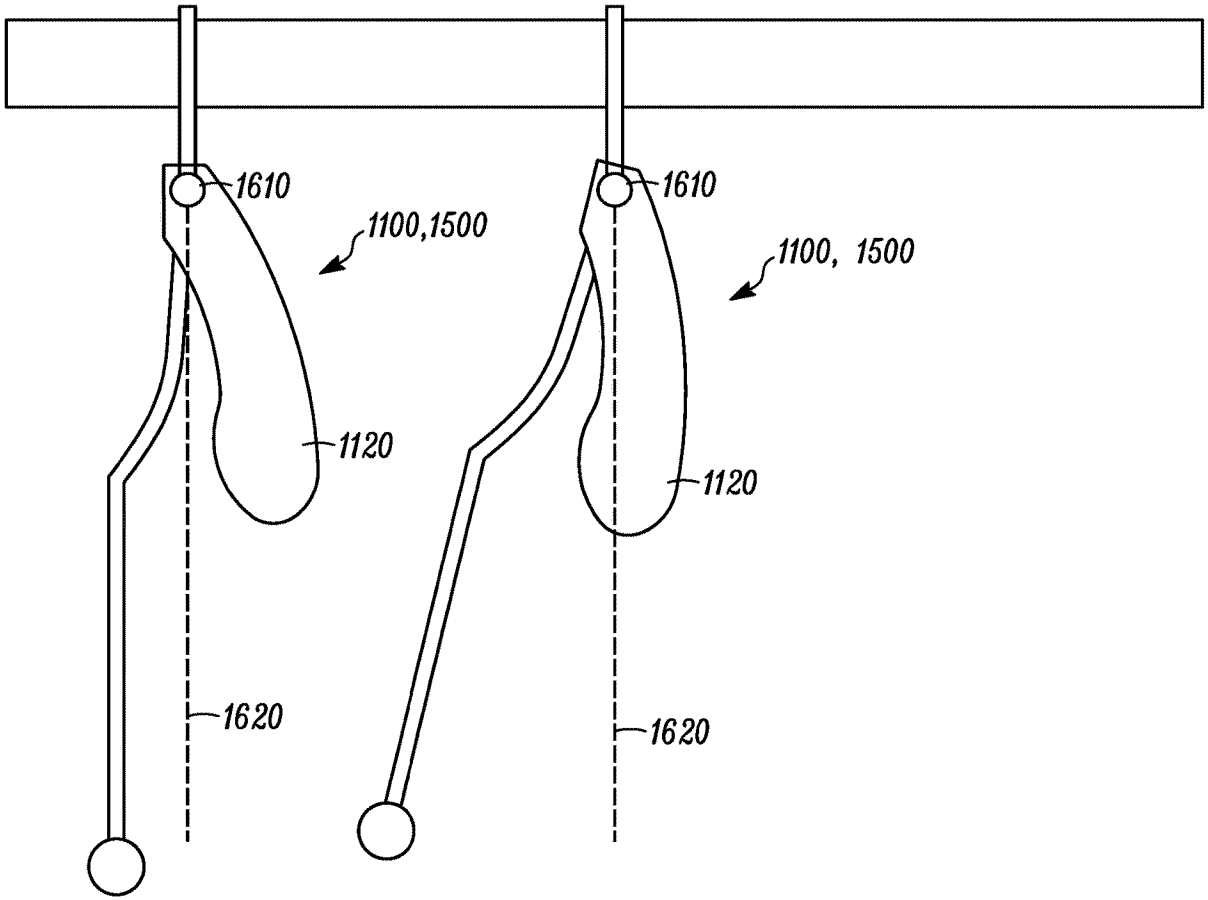
FIG. 16 a schematic view of a connection of the multi-position hanger with a pivot point in the wishbone, in a nested position and in a kick out position, according to an example embodiment.

FIG. 16 a schematic view of a connection of the multi-position hanger 1100 with a pivot point 1610 in the wishbone 1120, in a nested position and in a kick out position, according to an example embodiment. The kickout position is shown on the right of FIG. 16. In this position, the pants bar is farther away from an axis of the hanger which passes through the hook and the pivot point 1610 than in the fully nested position. It should be noted that the fully nested position is about the same as the unloaded position where no articles of clothing are on the pants bar or the wishbone. It should also be noted that the embodiments shown in FIGS. 14 and 15 will act similarly and that this schematic is equally applicable to both these embodiments.

As mentioned above, the hangers 1100 and 1500 have a separate wishbone 1120. Thus, the wishbone 1120 in these embodiments can be made of the same or a different material than the main body 1110 of the hanger 1100. In one embodiment, the wishbone 1120 can even be made of molded plastic.

Figure 17:
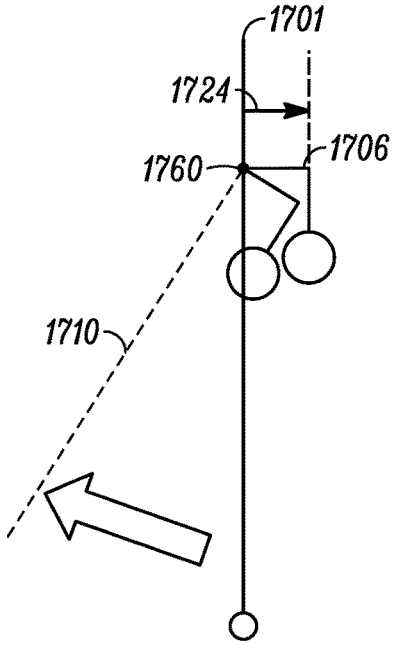
FIG. 17 is a schematic of still another embodiment of a hanger with lower pivot point, according to an example embodiment.
Figure 18:
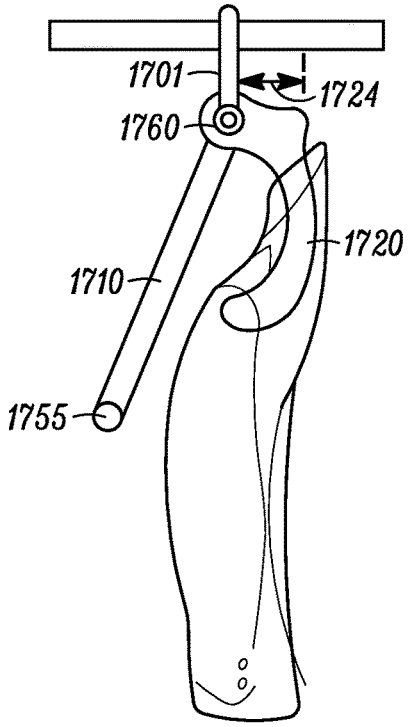
FIG. 18 is a side view of still another embodiment of a hanger with a coat on the wishbone, according to an example embodiment.
Figure 19:
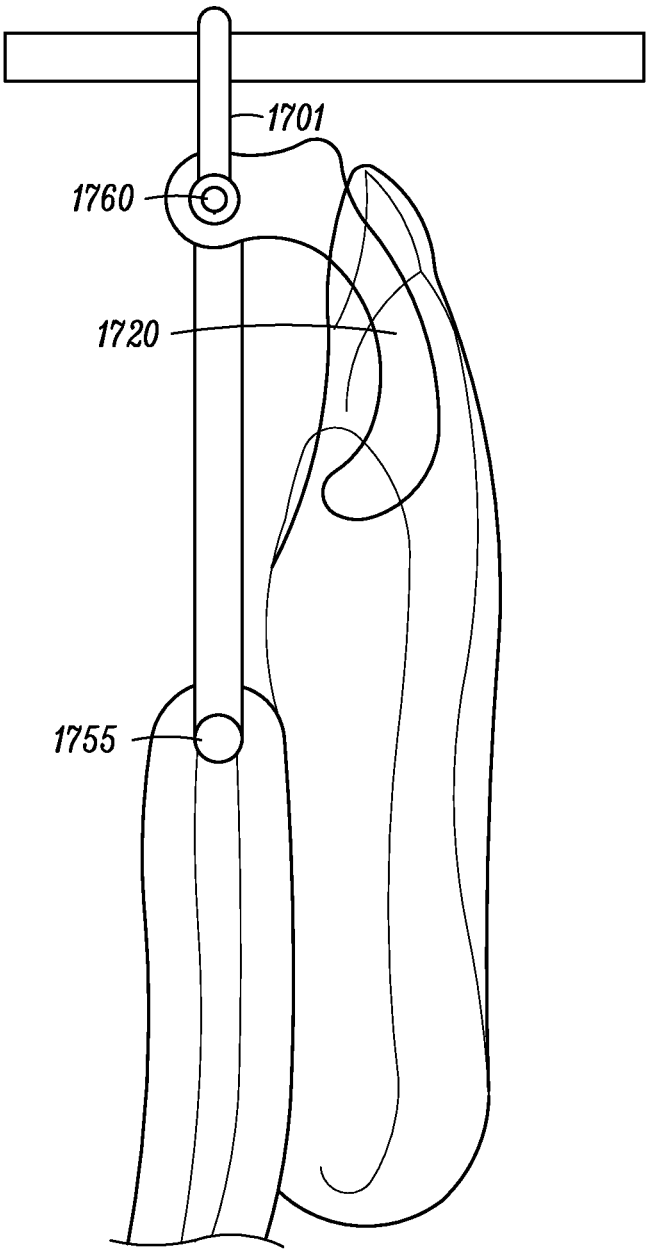
FIG. 19 is a side view of still another embodiment of a hanger with a coat on the wishbone and pants on the pants hanger bar, according to an example embodiment.

FIG. 17 is a schematic of still another embodiment of a hanger 1700 with lower pivot point, according to an example embodiment. FIG. 18 is a side view of still another embodiment of a hanger 1700 with a coat on the wishbone, according to an example embodiment. FIG. 19 is a side view of still another embodiment of a hanger 1700 with a coat on the wishbone and pants on the pants hanger bar, according to an example embodiment. Now referring to FIGS. 17-19, this embodiment will be further detailed.

The hanger 1700 includes a question mark hook 1701 and a cylindrical T-bar 1760 attached to the end of the question mark hook 1701, The question mark hook 1701 and T-bar, are similar to the embodiment shown in FIG. 14. The hanger 1700 also has a wishbone 1720 and a main body 1710. The wishbone 1720 is attached to the main body of the hanger 1710. A pants hanger bar 1755 is attached to the main body 1710.

The T-bar is cylindrical. The main body 1710 and wishbone 1720 rotate about the axis of the T-bar. The wishbone 1720 is offset from the cylindrical T-bar 1760 by a distance 1724. This offset can be formed at part of the wishbone 1720 or can be formed as a separate offset bar 1706. The wishbone 1720, the main body, and the pants bar 1755 all pivot around the cylindrical surface of the T-bar 1760, When a load is placed on the wishbone 1720, a clockwise moment is increased around the axis of rotation at the T-bar 1760. This causes wishbone 1720, the main body 1710 and the pants bar 1755 to rotate clockwise to a kick out position, as shown in FIG. 18. The pants bar 1755 is positioned away from the load (suit coat) on the wishbone 1720. The pants can be loaded onto the pants hanger bar 1755. This produces a counterclockwise moment to move the pants bar from the kickout position to the nested position shown in FIG. 19.

In summary, the various embodiments include a multi-position hanger including a main body, a hook, a wishbone and a pants bar. The hook is attached to the main body, and the wishbone attached to the main body. The wish bone is offset from the hook in a first direction. The pants bar is attached to the main body and is also offset from the hook in a second direction. The the multi-position hanger rotates to a kick out position in response to placing a load on the wishbone. The pants bar is positioned at a first distance from the load on the wishbone in the kick out position. Tthe multi-position hanger rotates to a nested position in response to placing a load on the pants bar. The pants bar is positioned at a second distance from the load on the wishbone when in the nested position, the first distance being greater than the second distance. In one embodiment of the multi-position hanger, a pivot point is associated with the hook. In another embodiment, of the multi-position hanger thea pivot point within the wishbone. In still another embodiment of the hanger the pivot point is located below the hook.

The multi-position hanger of further includes an offset bar. The offset bar attaches the wishbone at a distance away from the pivot point to produce a moment about the pivot point in a first direction. The pants bar attached to the multi-position hanger at a distance away from the pivot point to produce a moment about the pivot point in a second direction, the first direction being opposed to the second direction. In one embodiment, the offset bar is used to provide the offset to produce one or both of these moments about the pivot point. The first distance the pants bar is from load on the wishbone when in the kick out position is increased by increasing the distance the wishbone is offset from the pivot point.

In another embodiment, the hook of the multi-position hanger is rotatably attached to the wishbone to form the pivot point within the wishbone. In this embodiment, the multi-position hanger includes a cylindrical T bar attached to the hook. The cylindrical T bar is captured within the wishbone on at least one feature that allows the T-bar to rotate about a cylindrical axis of the T bar. The cylindrical axis passes though the radial center of the two ends of the cylinder. The multi-position hanger also includes a capture plate which attaches to a portion of the wishbone to capture the T-bar. The capture plate includes another feature for receiving a main body portion to attach the main body to the wishbone. The wishbone includes a slot through which the hook passes. The slot allows the hook and T-bar to rotate with respect to the wishbone.

In one embodiment, the pants bar includes a sleeve that fits over the pants bar. The sleeve increases the radius of the pants hander bar to reduce creasing across the leg of a pair of pants. The sleeve can be formed of a smooth material or a foam material which increases the friction between the pants bar and the pants. The sleeve can be made of other materials as well.

In still another embodiment, the multi-position hanger of further includes comprising a click stop which attaches to a portion of the wishbone. The click stop holds the hanger in at least one of the kick out position or the nested position. This can be held in either position regardless of whether the hanger is loaded or unloaded. In multi-position hanger with a click stop, the hook and T-bar are rotatable between the kick out position and the nested position. The click stop allows the rotation of the hook and T-bar between the positions. The click stop also holds the hook and T bar in one of the kick out position or the nested position.

This has been a detailed description of some exemplary embodiments of the invention(s) contained within the disclosed subject matter. Such invention(s) may be referred to, individually and/or collectively, herein by the term "invention" merely for convenience and without intending to limit the scope of this application to any single invention or inventive concept if more than one is in fact disclosed. The detailed description refers to the accompanying drawings that form a part hereof and which shows by way of illustration, but not of limitation, some specific embodiments of the invention, including a preferred embodiment. These embodiments are described in sufficient detail to enable those of ordinary skill in the art to understand and implement the inventive subject matter. Other embodiments may be utilized and changes may be made without departing from the scope of the inventive subject matter. Thus, although specific embodiments have been illustrated and described herein, any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

What is claimed:

1. A multi-position hanger comprising:

a hook member comprising a hook portion and a stem portion;

a wishbone rotatably attached to the stem portion of the hook member, the wishbone comprising a first arm that defines a first free end and an opposing second arm that defines a second free end; and a pants bar comprising a first end portion rigidly attached to the wishbone and a second end portion positioned below the wishbone and defining a free end spaced from the wishbone, wherein the pants bar is rotatable with respect to the stem portion of the hook member via the wishbone such that the pants bar is selectively reconfigurable between a kick out position with the second end portion of the pants bar positioned at a first lateral position with respect to a centerline extending vertically downward from the wishbone and a nested position with the second end portion of the pants bar positioned at a second lateral position with respect to the centerline, at least the first lateral position being laterally spaced from the centerline, and the first and second lateral positions being differing lateral positions with respect to the centerline, wherein the wishbone is positioned fully below the hook portion of the hook member when the pants bar is in the kick out and nested positions, and wherein the wishbone includes a first portion that engages and selectively retains the stem portion of the hook member when the pants bar is in the kick out position to selectively retain the pants bar in the kick out position.

2. The multi-position hanger of claim 1, comprising a pivot point within the wishbone.

3. The multi-position hanger of claim 2, wherein the stem portion of the hook member includes a T bar portion, and wherein the cylindrical T bar portion is rotatably captured within the wishbone such that the wishbone is able to rotate about the T bar portion.

4. The multi-position hanger of claim 3, wherein the wishbone comprises a capture plate which captures the T-bar portion.

5. The multi-position hanger of claim 2, wherein the wishbone includes a slot through which the stem portion of the hook member passes.

6. The multi-position hanger of claim 1, further comprising a sleeve extending over the second end portion of the pants bar.

7. The multi-position hanger of claim 6, wherein the sleeve is made from a foam material which increases a radius of the pants bar.

8. The multi-position hanger of claim 1, wherein the first portion of the wishbone that engages and retains the stem portion of the hook member when the pants bar is in the kick out position to selectively retain the pants bar in the kick out position comprises a tab portion of the wishbone.

9. The multi-position hanger of claim 8, wherein the tab portion of the wishbone comprises is flexible.

10. The multi-position hanger of claim 1, wherein the second end portion of the pants bar extends linearly.

11. The multi-position hanger of claim 10, wherein the pant bar further comprises an angled offset portion extending between the first and second end portions.

12. The multi-position hanger of claim 11, wherein the angled offset portion extends from the first end portion toward the free end one of the arms of the first and second arms of the wishbone and away from the other arm of the first and second arms of the wishbone.

13. The multi-position hanger of claim 1, wherein the stem portion of the hook member and the first end portion of the pants bar are substantially aligned.

14. The multi-position hanger of claim 1, wherein a lateral distance between the second end portion of the pants bar and the wishbone is a fixed distance.

15. The multi-position hanger of claim 1, wherein the second lateral position of the pants bar is aligned with the centerline.

16. The multi-position hanger of claim 1, wherein the second lateral position of the pants bar is laterally spaced from the centerline.

17. The multi-position hanger of claim 1, wherein the wishbone includes a second portion that engages the stem portion of the hook member when the pants bar is in the nested position to retain the pants bar in the nested position.

* * * * *